US007021901B2

(12) United States Patent
Hirota et al.

(10) Patent No.: US 7,021,901 B2
(45) Date of Patent: Apr. 4, 2006

(54) VARIABLE DISPLACEMENT COMPRESSOR

(75) Inventors: Hisatoshi Hirota, Tokyo (JP); Tomokazu Nakazawa, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 113 days.

(21) Appl. No.: 10/700,462

(22) Filed: Nov. 5, 2003

(65) Prior Publication Data

US 2004/0091369 A1 May 13, 2004

Related U.S. Application Data

(63) Continuation of application No. PCT/JP02/05635, filed on Jun. 6, 2002.

(30) Foreign Application Priority Data

Jun. 6, 2001 (JP) ..... 2001-170435

(51) Int. Cl.
*F04B 1/26* (2006.01)

(52) U.S. Cl. ..... 417/222.2

(58) Field of Classification Search ..... 417/222.1, 417/222.2
See application file for complete search history.

(56) References Cited

U.S. PATENT DOCUMENTS

| | | | | |
|---|---|---|---|---|
| 5,785,502 | A * | 7/1998 | Ota et al. | 417/222.2 |
| 6,045,337 | A * | 4/2000 | Tokumasu | 417/213 |
| 6,385,982 | B1 | 5/2002 | Ota et al. | |
| 6,481,977 | B1 * | 11/2002 | Mameda et al. | 417/222.2 |
| 2001/0052236 | A1 | 12/2001 | Ota et al. | |

FOREIGN PATENT DOCUMENTS

| | | |
|---|---|---|
| EP | 0 992 745 | 4/2000 |
| EP | 1 039 129 | 9/2000 |

(Continued)

OTHER PUBLICATIONS

European Search Report for the corresponding European patent application No. EP 02 73 6020.

(Continued)

*Primary Examiner*—Charles G. Freay
(74) *Attorney, Agent, or Firm*—Westerman, Hattori, Daniels & Adrian, LLP

(57) ABSTRACT

An object of the invention is to provide a variable displacement compressor which is capable of using a solenoid control valve which does not require a large solenoid force. The compressor is configured such that an electromagnetic proportional flow rate control valve is arranged in a refrigerant passage leading from a discharge chamber to a condenser, that a differential pressure regulating valve is arranged in a refrigerant passage leading from the discharge chamber to a crank chamber, and that a fixed orifice is arranged in a refrigerant passage leading from the crank chamber to a suction chamber, whereby the differential pressure regulating valve senses a differential pressure Pd, Pd' generated across the electromagnetic proportional flow rate control valve, for control of pressure introduced into the crank chamber. Due to this configuration, the differential pressure regulating valve controls pressure Pc in the crank chamber such that the difference of pressure of refrigerant before and after passing through a restriction having openness set by the electromagnetic proportional flow rate control valve becomes constant, which makes the flow rate Qd of discharged refrigerant constant irrespective of changes in the engine rotational speed, etc. Since the differential pressure can be controlled by a small solenoid force, the variable displacement compressor can be made compact in size.

6 Claims, 8 Drawing Sheets

FOREIGN PATENT DOCUMENTS

| | | |
|---|---|---|
| EP | 1 074 800 | 2/2001 |
| EP | 1 098 091 | 5/2001 |
| EP | 1 101 639 | 5/2001 |
| EP | 1 162 370 | 12/2001 |

OTHER PUBLICATIONS

Patent Abstracts of Japan, Publication No. 2001-349624, dated Dec. 21, 2001. Cited in the int'l. search report.

Patent Abstracts of Japan, Publication No. 2001-107854, dated Apr. 17, 2001. Cited in the int'l. search report.

Patent Abstracts of Japan, Publication No. 2001-140767, dated May 22, 2001. Cited in the intl'l. search report.

Patent Abstracts of Japan, Publication No. 06-330856, dated Nov. 29, 1994. Cited in the intl'.l search report.

Patent Abstracts of Japan, Publication No. 2001-132650, dated May 18, 2001.

* cited by examiner

VARIABLE DISPLACEMENT COMPRESSOR

This application is a continuing application, filed under 35 U.S.C. §111(a), of International Application PCT/JP02/05635, filed on Jun. 6, 2002.

BACKGROUND OF THE INVENTION (1) Field of the Invention

This invention relates to a variable displacement compressor, and more particularly to a variable displacement compressor for use in compressing a refrigerant gas in a refrigeration cycle of an automotive air conditioner.

(2) Description of the Related Art

A compressor used for compressing refrigerant in a refrigeration cycle of an automotive air conditioner is driven by an engine, and hence the rotational speed of the compressor cannot be controlled. For this reason, a variable displacement compressor capable of changing the capacity of refrigerant to be compressed is employed so as to obtain adequate cooling power without constraints of the rotational speed of the engine.

In such a variable displacement compressor, compression pistons are connected to a wobble plate fitted on a shaft driven for rotation by the engine, and the angle of the wobble plate is changed to vary the length of piston stroke, whereby the discharge capacity of refrigerant is changed.

The angle of the wobble plate is continuously changed by introducing part of the compressed refrigerant into a gastight crank chamber and changing the pressure of the introduced refrigerant, thereby changing a balance between pressures applied to the both ends of each piston.

The variable displacement compressor has a solenoid control valve arranged between a discharge port for delivering refrigerant and the crank chamber or between the crank chamber and a suction port. This solenoid control valve opens and closes the communication such that the differential pressure across the solenoid control valve is maintained at a predetermined value. The predetermined value of the differential pressure can be externally set by a current value. Due to this configuration, when the engine rotational speed increases, the pressure introduced into the crank chamber is increased to reduce the capacity for compression, while when the engine rotational speed decreases, the pressure introduced into the crank chamber is reduced to increase the capacity for compression, whereby the pressure of refrigerant discharged from the compressor is maintained at a constant level.

Although a chlorofluorocarbon substitute HFC-134a is generally used as a refrigerant in a refrigeration cycle of an automotive air conditioner, there has recently been developed a refrigeration cycle which causes refrigerant to perform refrigeration in a supercritical region where the temperature of the refrigerant is above its critical temperature, e.g. a refrigeration cycle using carbon dioxide as refrigerant.

However, in the solenoid control valve for controlling the pressure introduced into the crank chamber according to the discharge pressure of the compressor, in the case of the refrigeration cycle using carbon dioxide as the refrigerant, since the pressure of the refrigerant is increased to the supercritical region, the differential pressure between the discharge port for delivering the refrigerant and the crank chamber or between the discharge port and the suction port becomes very large, and hence a solenoid force for controlling the differential pressure also becomes very large. This necessitates a large-sized solenoid, causing an increase in the size of the solenoid control valve, which results in increased manufacturing costs.

SUMMARY OF THE INVENTION

The present invention has been made in view of these points, and an object thereof is to provide a variable displacement compressor capable of employing a solenoid control valve which does not necessitate a large solenoid force when it is used in a refrigeration cycle using high-pressure refrigerant operable in a supercritical region, to say nothing of a case in which it is used in a refrigeration cycle using HFC-134a commonly used as refrigerant.

To solve the above problem, there is provided a variable displacement compressor including a wobble body that is arranged in a crank chamber formed gastight, such that an inclination angle of the wobble body can be changed with respect to a rotating shaft, and is driven by rotation of the rotating shaft, for wobbling motion, and pistons connected to the wobble body, for performing reciprocating motion in a direction along axis in accordance with the wobbling motion of the wobble body, to thereby suction refrigerant from a suction chamber into a cylinder, compress the refrigerant, and deliver the compressed refrigerant from the cylinder to a discharge chamber, the variable displacement compressor comprising a variable orifice arranged in a suction-side refrigerant passage leading to the suction chamber or a discharge-side refrigerant passage leading to the discharge chamber, such that an openness thereof can be set according to changes in external conditions, a differential pressure regulating valve arranged at a desired location in a first refrigerant passage leading from the discharge chamber to the crank chamber, and a second refrigerant passage leading from the crank chamber to the suction chamber, for sensing a differential pressure generated across the variable orifice and adjusting an openness thereof such that the differential pressure becomes equal to a predetermined value, and a fixed orifice arranged at a desired location in the first refrigerant passage and the second refrigerant passage, wherein a flow rate of refrigerant flowing into the suction chamber or a flow rate of the refrigerant discharged from the discharge chamber is caused to become substantially constant.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
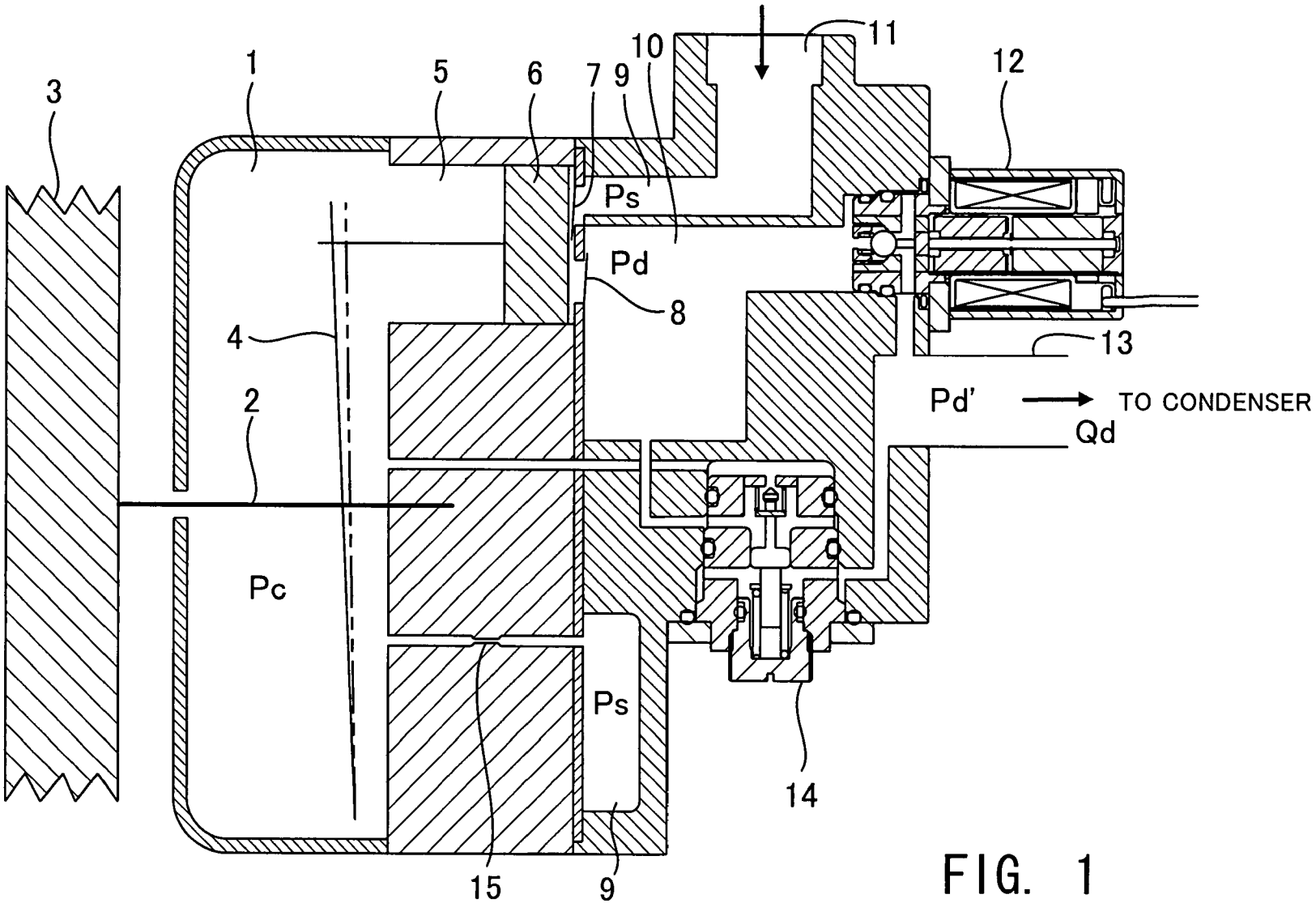
FIG. 1 is a cross-sectional view showing the construction of a variable displacement compressor according to a first embodiment of the invention.
Figure 2:
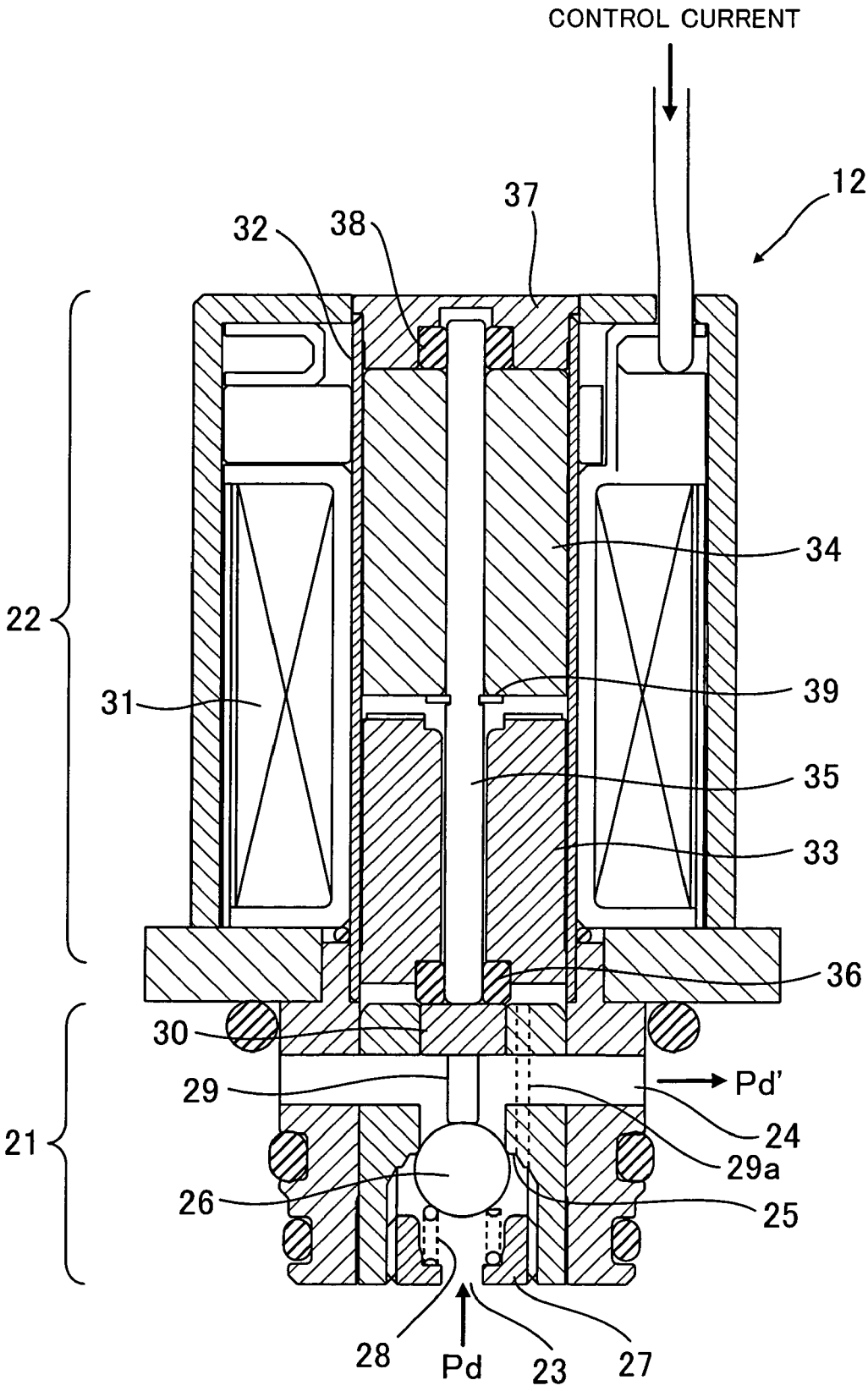
FIG. 2 is a cross-sectional view showing in detail the construction of an electromagnetic proportional flow rate control valve of the variable displacement compressor according to the first embodiment.
Figure 3:
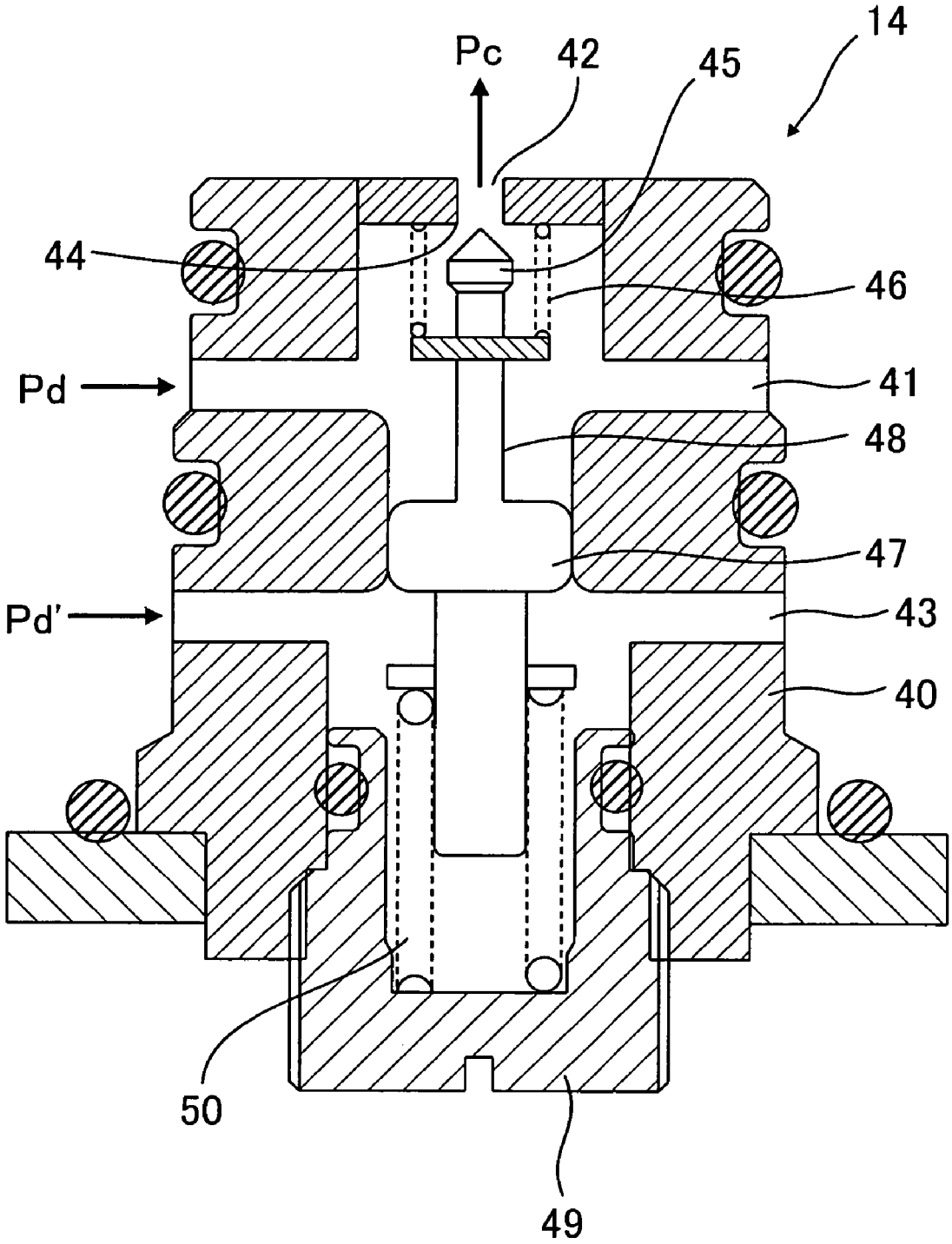
FIG. 3 is a cross-sectional view showing in detail the construction of a differential pressure regulating valve of the variable displacement compressor according to the first embodiment.

An embodiment of the present invention will be described in detail hereafter with reference to the accompanying drawings. FIG. 1 is a cross-sectional view showing the construction of a variable displacement compressor according to a first embodiment of the invention. FIG. 2 is a cross-sectional view showing in detail the construction of an electromagnetic proportional flow rate control valve of the variable displacement compressor according to the first embodiment. FIG. 3 is a cross-sectional view showing in detail the construction of a differential pressure regulating valve of the variable displacement compressor according to the first embodiment.

The variable displacement compressor according to the present invention includes a crank chamber 1 formed gastight and a rotating shaft 2 rotatably supported in the crank chamber 1. The rotating shaft 2 has one end extending out of the crank chamber 1 via a shaft sealing device, not shown, with a pulley 3 fixed thereto for receiving transmission of a driving force from an output shaft of an engine via a clutch and a belt. A wobble plate 4 is fitted on the rotating shaft 2 such that the inclination angle of the wobble plate 4 can be changed. A plurality of cylinders 5 (only one of which is shown in the figure) are arranged around the axis of the rotating shaft 2. In each cylinder 5, there is arranged a piston 6 for converting rotating motion of the wobble plate 4 to reciprocating motion. Each cylinder 5 is connected to a suction chamber 9 and a discharge chamber 10 via a suction relief valve 7 and a discharge relief valve 8, respectively.

It should be noted that the variable displacement compressor includes the plurality of cylinders 5, and the respective suction chambers 9 formed adjacent to the cylinders 5 communicate with each other to form one chamber which is connected to a refrigerant passage 11 on the suction side of the compressor, while the respective discharge chambers 10 formed adjacent to the cylinders 5 communicate with each other to form one chamber which is connected to a refrigerant passage 13 on the discharge side of the compressor.

The suction chamber 9 is connected to the refrigerant passage 11 communicating with an evaporator, and the discharge chamber 10 is connected to the refrigerant passage 13 communicating with a condenser or a gas cooler via an electromagnetic proportional flow rate control valve 12. The electromagnetic proportional flow rate control valve 12 forms a variable orifice which is capable of proportionally changing the area of a flow passage communicating between the discharge chamber 10 and the refrigerant passage 13 in response to an external signal.

The discharge chamber 10 is also connected to the crank chamber 1 via the differential pressure regulating valve 14, and the crank chamber 1 is connected to the suction chamber 9 via a fixed orifice 15. The differential pressure regulating valve 14 introduces therein discharge pressure Pd from the discharge chamber 10 and pressure Pd' having passed through the electromagnetic proportional flow rate control valve 12 from the refrigerant passage 13, and controls refrigerant flowing from the discharge chamber 10 to the crank chamber 1, and further from the crank chamber 1 to the suction chamber 9 via the fixed orifice 15 such that the differential pressure generated across the electromagnetic proportional flow rate control valve 12 is constant. It should be noted that Ps designates suction pressure, Pc designates pressure in the crank chamber 1, and Qd designates a discharge flow rate.

Referring to FIG. 2, the electromagnetic proportional flow rate control valve 12 comprises a valve section 21 and a solenoid section 22. The valve section 21 includes a port 23 for introducing the discharge pressure Pd from the discharge chamber 10, and a port 24 for guiding out the pressure Pd' reduced by the valve section 21 into the refrigerant passage 13. A passage communicating between these ports is formed with a valve seat 25, and on the upstream side of the valve seat 25 is arranged a ball valve element 26 in a manner opposed to the valve seat 25. An adjusting screw 27 is screwed into an open end of the port 23, and a spring 28 is arranged between the valve element 26 and the adjusting screw 27, for urging the valve element 26 in the valve-closing direction. Further, the valve element 26 is in abutment with one end of a shaft 29 axially extending through a valve hole. The other end of the shaft 29 is rigidly fixed to a piston 30 arranged in an axially movable manner. The piston 30 has substantially the same cross-sectional area as that of the valve hole such that the pressure Pd' on the downstream side of the valve element 26 is equally applied in respective axial both directions to prevent the pressure Pd' from adversely affecting the control of the valve element 26. Further, a communication passage **29*a* is formed between a space on the upstream side of the valve element 26 and a space on a solenoid section side of the piston 30 such that the discharge pressure Pd is introduced on a back pressure side of the piston 30 to thereby cancel out the discharge pressure Pd applied to the valve element 26**.

The solenoid section 22 has a magnet coil 31 having a hollow cylindrical void portion in which is arranged a sleeve 32. The sleeve 32 has a core 33 forming a fixed core, rigidly fixed to a portion thereof toward the valve section 22 by press-fitting, and a plunger 34 forming a movable core, axially movably inserted therein. A shaft 35 is axially arranged through the core 33 and the plunger 34, and has one end thereof supported via a guide 36 by the core 33, and the other end thereof supported via a guide 38 by a cap 37 arranged on an upper end, as viewed in the figure, of the sleeve 32. The shaft 35 has an E ring 39 fitted on an approximately central portion thereof such that the shaft 35 is moved together with the plunger 34 when the plunger 34 is attracted toward the core 33. Due to this configuration, when the plunger 34 is moved downward, as viewed in the figure, the shaft 35 pushes the piston 30 abutting a lower end thereof, as viewed in the figure, which acts on the valve element 26 in the valve-opening direction. The amount of movement of the shaft 35 is proportional to the value of an electric current supplied to the magnet coil 31. Therefore, the area of a flow passage of refrigerant passing through the electromagnetic proportional flow rate control valve 12 can be determined depending on the value of the control current supplied to the magnet coil 31. The solenoid section 22 is for providing control such that the discharge flow rate Qd of refrigerant passing through the valve section 21 produces a small differential pressure, but not for directly controlling high pressure, and hence only a small solenoid force is required. This makes it possible to make the solenoid section 22 compact in size.

As shown in FIG. 3, the differential pressure regulating valve 14 has a body 40 formed with a port 41 for introducing therein the discharge pressure Pd from the discharge chamber 10, a port 42 for introducing the pressure Pc controlled by the differential pressure regulating valve 14 into the crank chamber 1, and a port 43 for introducing therein the pressure Pd' reduced by the electromagnetic proportional flow rate control valve 12.

A passage communicating between the port 41 and the port 42 is formed with a valve seat 44, and on the upstream side of the valve seat 44 is arranged a valve element 45 in a manner opposed to the valve seat 44. The valve element 45 is formed with a flange, and a spring 46 is arranged between the valve seat 44 and the flange, for urging the valve element 45 in the valve-opening direction.

On the same axis as that of the valve element 45, there is arranged a pressure-sensing piston 47 which is axially movably disposed for receiving the discharge pressure Pd from the port 41 and the pressure Pd' from the port 43 on respective both end surfaces thereof. The pressure-sensing piston 47 is rigidly fixed to the valve element 45 by a shaft 48 integrally formed therewith.

On a lower side of the pressure-sensing piston 47, as viewed in the figure, a spring load-adjusting screw 49 is screwed into the body 40. Arranged between the pressure-sensing piston 47 and the load-adjusting screw 49 is a spring 50 for urging the pressure-sensing piston 47 in the direction of closing of the valve element 45.

In the variable displacement compressor constructed as above, when a driving force is transmitted from the engine to rotate the rotating shaft 2, the wobble plate 4 fitted on the rotating shaft 2 is rotated. This causes the pistons 6 connected to an outer periphery of the wobble plate 4 to perform reciprocating motion, whereby refrigerant in the suction chamber 9 is drawn into the cylinders 5 to be compressed therein, and the compressed refrigerant is delivered to the discharge chamber 10.

At this time, the electromagnetic proportional flow rate control valve 12 supplied with a predetermined control current narrows down the refrigerant passage 13 communicating with the condenser to thereby form an orifice of a predetermined size such that a predetermined differential pressure (Pd−Pd') is generated by the flow rate Qd of the refrigerant.

Further, in the differential pressure regulating valve 14, the pressure-sensing piston 47 receives the predetermined differential pressure (Pd>Pd'), and the valve element 45 is made stationary in a position where a force directed downward, as viewed in the figure, caused by the predetermined differential pressure, and the loads of the springs 46, 50 are balanced, to thereby control the openness of the differential pressure regulating valve 14. Therefore, the differential pressure regulating valve 14 senses the differential pressure across the electromagnetic proportional flow rate control valve 12, in which the orifice is determined by the control current, and adjusts the openness thereof such that the differential pressure becomes equal to a predetermined value (i.e. a fixed flow rate) set in advance, thereby controlling the flow rate of refrigerant introduced into the crank chamber 1.

Now, when the differential pressure generated across the electromagnetic proportional flow rate control valve 12 is increased e.g. due to an increase in the engine rotational speed, the discharge pressure Pd of refrigerant is increased, so that the pressure-sensing piston 47 of the differential pressure regulating valve 14 is moved downward, as viewed in FIG. 3, which acts on the valve element 45 in the valve-opening direction. This increases the flow rate of refrigerant introduced from the discharge chamber 10 into the crank chamber 1, thereby increasing the pressure Pc in the crank chamber 1, so that the variable displacement compressor is controlled to a minimum operation side to reduce the flow rate of refrigerant discharged from the discharge chamber 10. This control operation is continued until the differential pressure across the electromagnetic proportional flow rate control valve 12 becomes equal to a differential pressure corresponding to the openness set by the solenoid section 22. As a result, the discharge flow rate Qd of refrigerant comes to be held constant.

Inversely, when the differential pressure generated across the electromagnetic proportional flow rate control valve 12 is decreased e.g. due to a decrease in the engine rotational speed, the discharge pressure Pd of refrigerant is decreased, so that the pressure-sensing piston 47 of the differential pressure regulating valve 14 is moved upward, as viewed in FIG. 3, which acts on the valve element 45 in the valve-closing direction. This decreases the flow rate of refrigerant introduced into the crank chamber 1, thereby decreasing the pressure Pc in the crank chamber 1, so that the variable displacement compressor is controlled to a maximum operation side to increase the flow rate of refrigerant discharged from the discharge chamber 10. This control operation is continued until the differential pressure across the electromagnetic proportional flow rate control valve 12 becomes equal to the differential pressure corresponding to the openness set by the solenoid section 22, whereby the discharge flow rate Qd of refrigerant comes to be held constant.

As described above, the differential pressure regulating valve 14 senses the differential pressure across the electromagnetic proportional flow rate control valve 12 arranged in the discharge-side refrigerant passage 13, and controls the flow rate of refrigerant introduced from the discharge chamber 10 into the crank chamber 1, based on the sensed differential pressure, whereby the discharge flow rate Qd of refrigerant discharged from the variable displacement compressor is controlled to a fixed flow rate corresponding to a differential pressure generated by the electromagnetic proportional flow rate control valve 12.

Figure 4:
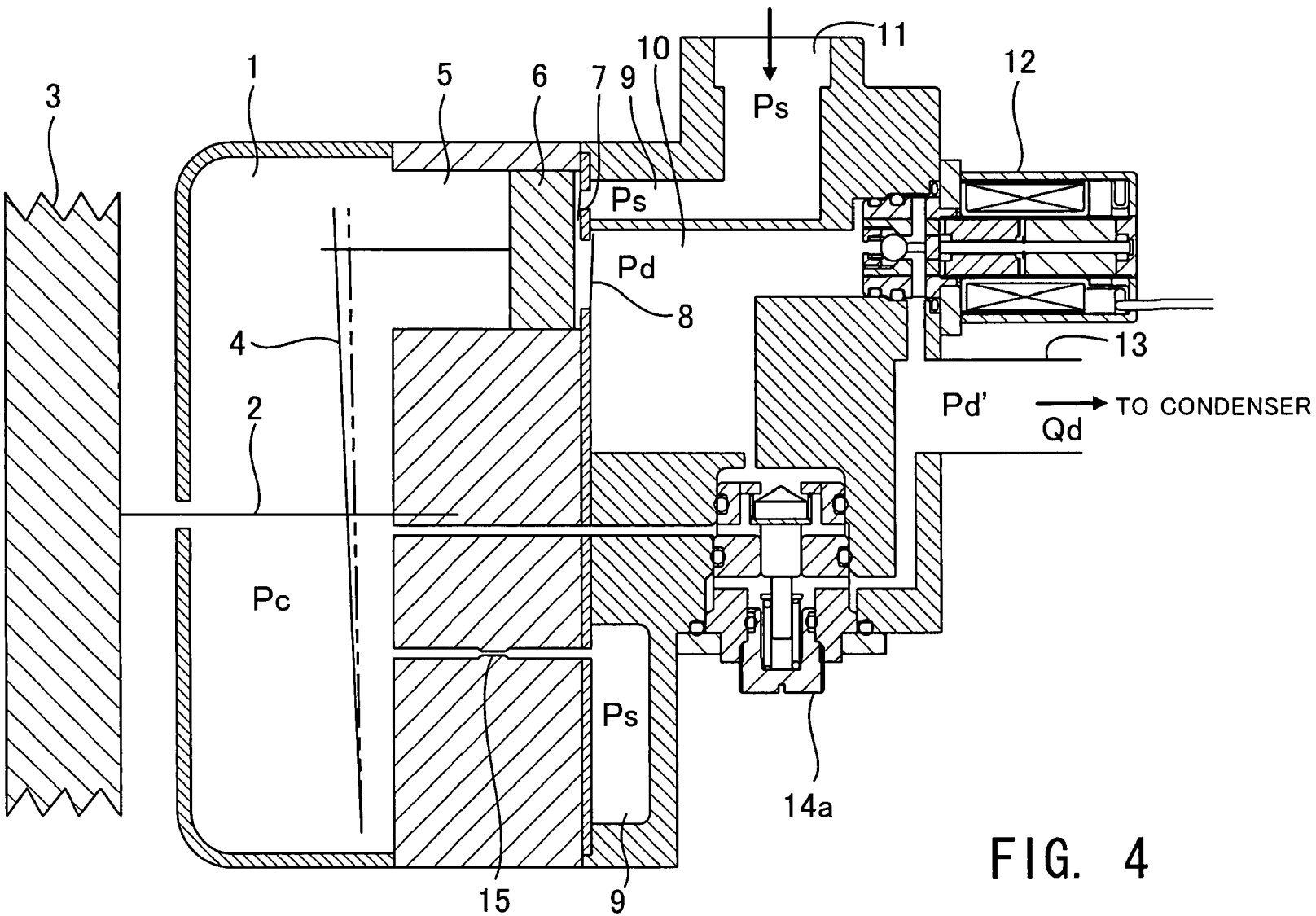
FIG. 4 is a cross-sectional view showing the construction of a variable displacement compressor according to a second embodiment.
Figure 5:
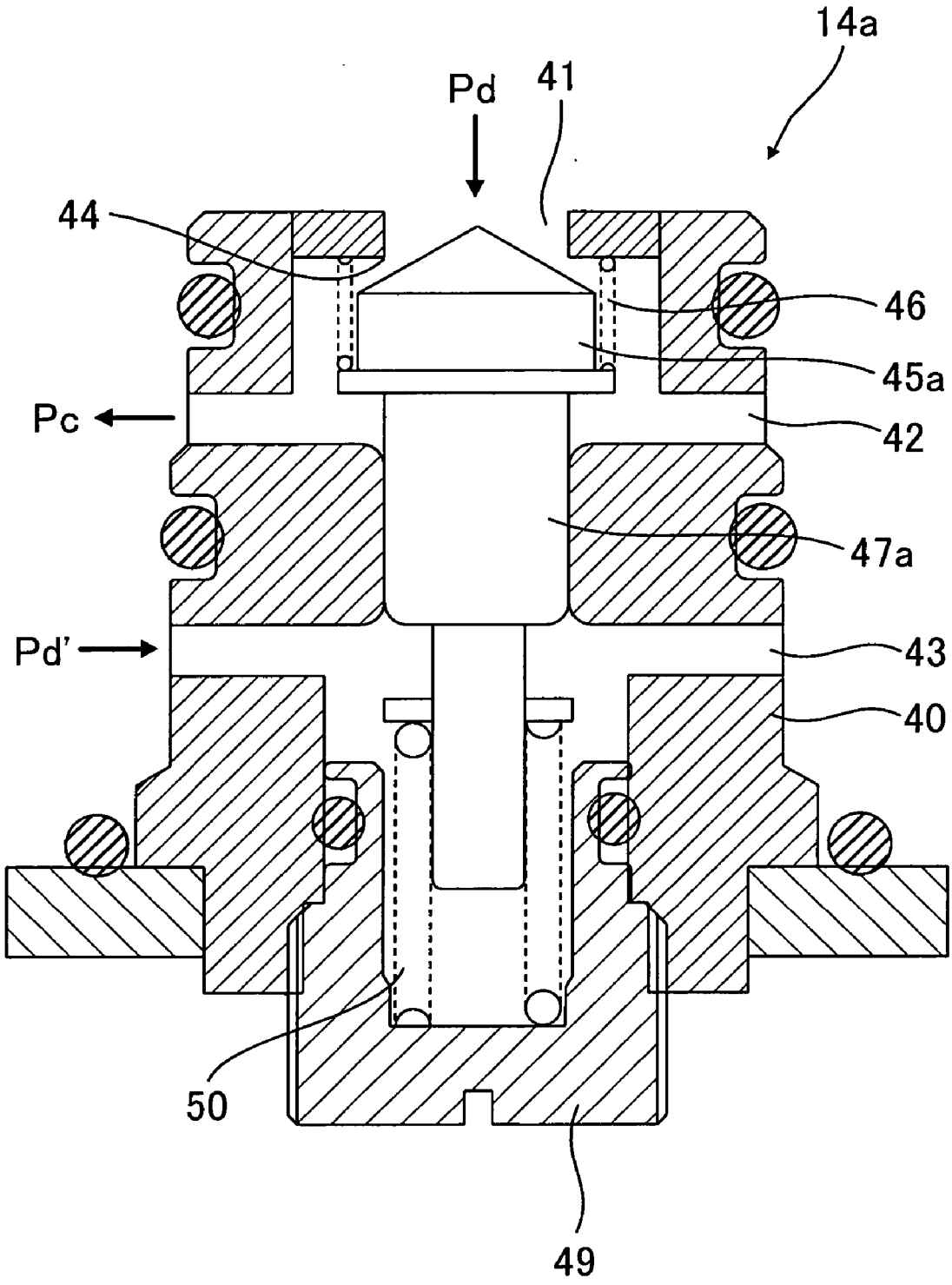
FIG. 5 is a cross-sectional view showing in detail the construction of a differential pressure regulating valve of the variable displacement compressor according to the second embodiment.

FIG. 4 is a cross-sectional view showing the construction of a variable displacement compressor according to a second embodiment. FIG. 5 is a cross-sectional view showing in detail the construction of a differential pressure regulating valve of the variable displacement compressor according to the second embodiment. It should be noted that in FIGS. 4 and 5, component elements similar to or equivalent to those shown in FIG. 1 and FIG. 3 are designated by identical reference numerals, and detailed description thereof is omitted.

In the second embodiment, when compared with the variable displacement compressor according to the first embodiment, although an electromagnetic proportional flow rate control valve 12 is arranged at the same location and has the same construction, the differential pressure regulating valve **14*a*** is different in that discharge pressure Pd is introduced in the valve-opening direction thereof and the construction thereof is modified.

As shown in FIG. 5, the differential pressure regulating valve **14*a* has a body 40 formed with a port 41 for introducing therein discharge pressure Pd from a discharge chamber 10, a port 42 for introducing pressure Pc controlled by the differential pressure regulating valve 14***a* into a crank chamber 1, and a port 43 for introducing therein pressure Pd' reduced by the electromagnetic proportional flow rate control valve 12.

A valve seat 44 is formed on a side toward the port 41 for introducing the discharge pressure Pd, and a valve element 45*a* is arranged on the downstream side of the valve seat 44 in a manner opposed to the valve seat 44. Further, a spring 46 is arranged for urging the valve element 45*a* in the valve-opening direction.

A pressure-sensing piston 47*a* is axially movably arranged on the same axis as that of the valve element 45*a* and has the same diameter as that of a valve hole. Further, the pressure-sensing piston 47*a* is rigidly fixed to the valve element 45*a*, and urged by a spring 50 in the direction of closing of the valve element 45*a*.

Also in the variable displacement compressor constructed as above, similarly to the variable displacement compressor according to the first embodiment, the differential pressure regulating valve 14*a* senses a differential pressure across the electromagnetic proportional flow rate control valve 12, and controls the flow rate of refrigerant which is introduced from the discharge chamber 10 into the crank chamber 1, based on the sensed differential pressure, thereby controlling the discharge flow rate Qd of refrigerant discharged from the variable displacement compressor to a fixed flow rate corresponding to a differential pressure generated by the electromagnetic proportional flow rate control valve 12.

Figure 6:
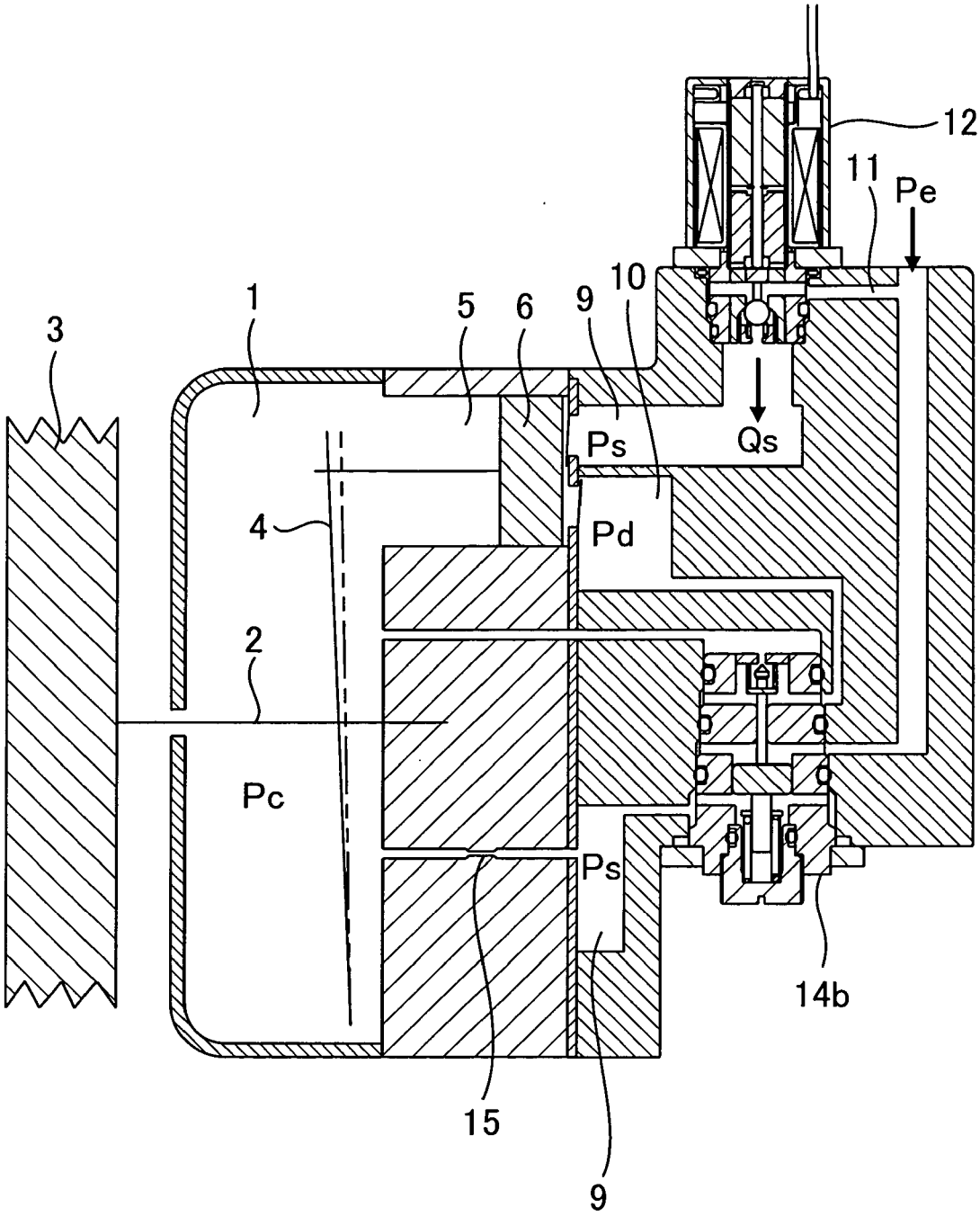
FIG. 6 is a cross-sectional view showing the construction of a variable displacement compressor according to a third embodiment.
Figure 7:
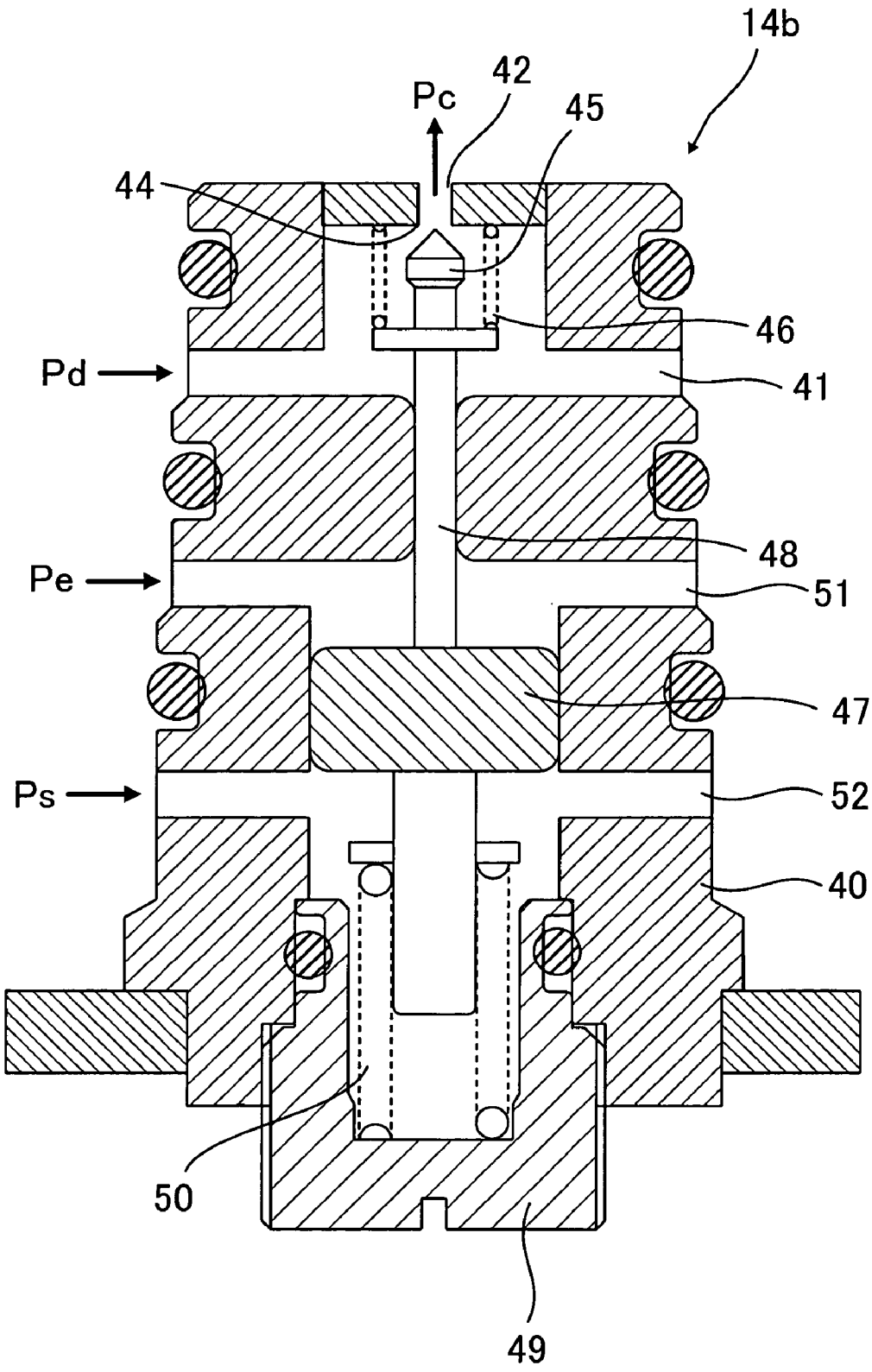
FIG. 7 is a cross-sectional view showing in detail the construction of a differential pressure regulating valve of the variable displacement compressor according to the third embodiment.

FIG. 6 is a cross-sectional view showing the construction of a variable displacement compressor according to a third embodiment. FIG. 7 is a cross-sectional view showing in detail the construction of a differential pressure regulating valve of the variable displacement compressor according to the third embodiment. It should be noted that in FIGS. 6 and 7, component elements similar to or equivalent to those shown in FIG. 1 and FIG. 3 are designated by identical reference numerals, and detailed description thereof is omitted.

In the variable displacement compressor according to the third embodiment, an electromagnetic proportional flow rate control valve 12 is arranged at an intermediate portion of a refrigerant passage 11 communicating between an evaporator and a suction chamber 9; the differential pressure regulating valve 14*b* is arranged at an intermediate portion of a refrigerant passage communicating between a discharge chamber 10 and a crank chamber 1, for controlling the discharge capacity; and a fixed orifice 15 is provided at an intermediate portion of a refrigerant passage between the crank chamber 1 and the suction chamber 9. Further, there are also formed passages for introducing respective pressures Pe, Ps on the upstream side and downstream side of the electromagnetic proportional flow rate control valve 12 into the differential pressure regulating valve 14*b*.

The electromagnetic proportional flow rate control valve 12 has the same construction as that of the electromagnetic proportional flow rate control valves 12 employed in the first and second embodiments. However, refrigerant flows in the valve-closing direction in the first and second embodiments, whereas the same flows in the valve-opening direction in the present embodiment.

As shown in FIG. 7, the differential pressure regulating valve 14*b* has a body 40 formed with a port 41 for introducing therein discharge pressure Pd from the discharge chamber 10, a port 42 for introducing pressure Pc controlled by the differential pressure regulating valve 14*b* into the crank chamber 1, a port 51 for introducing therein the pressure Pe from the evaporator, and a port 52 for introducing therein the suction pressure Ps drawn into the suction chamber 9 through the electromagnetic proportional flow rate control valves 12.

A passage communicating between the port 41 and the port 42 is formed with a valve seat 44, and on the upstream side of the valve seat 44 is arranged a valve element 45 in a manner opposed to the valve seat 44. The valve element 45 is formed with a flange, and a spring 46 is arranged between the valve seat 44 and the flange, for urging the valve element 45 in the valve-opening direction.

On the same axis as that of the valve element 45, there is arranged a pressure-sensing piston 47 which is axially movably disposed for receiving the pressure Pe from the port 51 and the suction pressure Ps from the port 52 on respective both end surfaces thereof. The pressure-sensing piston 47 is urged by a spring 50 in the direction of closing of the valve element 45.

In the variable displacement compressor constructed as above, when a rotating shaft 2 is rotated by a driving force from the engine to rotate a wobble plate 4 fitted on the rotating shaft 2, pistons 6 connected to the wobble plate 4 perform reciprocating motion, whereby refrigerant in the suction chamber 9 is drawn into cylinders 5 to be compressed therein, and the compressed refrigerant is delivered to the discharge chamber 10.

At this time, the electromagnetic proportional flow rate control valve 12 is supplied with a predetermined control current to narrow down a refrigerant passage communicating between the evaporator and the suction chamber 9, to thereby form an orifice of a predetermined size such that a predetermined differential pressure (Pe−Ps) is generated by the flow rate Qs of refrigerant drawn into the suction chamber 9.

Further, the pressure-sensing piston 47 receives the predetermined differential pressure (Pe>Ps), and the openness of the differential pressure regulating valve 14*b* is controlled to a position where a force directed downward, as viewed in the figure, caused by the predetermined differential pressure, and the loads of the springs 46, 50 are balanced. Thus, the differential pressure regulating valve 14*b* senses the differential pressure across the electromagnetic proportional flow rate control valve 12, in which the orifice is determined by a control current, and adjusts the openness thereof such that the differential pressure becomes equal to a predetermined value set in advance, thereby controlling the flow rate of refrigerant introduced into the crank chamber 1. As a result, the flow rate Qs of the refrigerant drawn into the suction chamber 9 is controlled to be constant, whereby the flow rate Qd of refrigerant discharged from the discharge chamber 10 is controlled to be constant.

Now, when discharge capacity of the variable displacement compressor is increasingly changed e.g. due to an increase in the engine rotational speed to thereby increase the differential pressure across the electromagnetic proportional flow rate control valve 12, the suction pressure Ps of refrigerant is reduced, and hence the pressure-sensing piston 47 of the differential pressure regulating valve 14*b* is moved downward, as viewed in FIG. 7, which acts on the valve element 45 in the valve-opening direction. This increases the flow rate of refrigerant introduced from the discharge chamber 10 into the crank chamber 1, thereby increasing the pressure Pc in the crank chamber 1, so that the variable displacement compressor is controlled to a minimum operation side to decrease the flow rate of refrigerant drawn into the suction chamber. This control operation is continued until the differential pressure across the electromagnetic proportional flow rate control valve 12 becomes equal to a differential pressure corresponding to the openness set by a solenoid section 22. As a result, since the suction flow rate Qs of refrigerant is held constant, the discharge flow rate Qd of refrigerant is also held constant.

Inversely, when the discharge capacity of the variable displacement compressor is decreasingly changed e.g. due to a decrease in the engine rotational speed to thereby reduce the differential pressure across the electromagnetic proportional flow rate control valve 12, the suction pressure Ps of refrigerant is increased, and hence the pressure-sensing piston 47 of the differential pressure regulating valve 14*b* is moved upward, as viewed in FIG. 7, which acts on the valve element 45 in the valve-closing direction. This decreases the flow rate of refrigerant introduced into the crank chamber 1, thereby decreasing the pressure Pc in the crank chamber 1, so that the variable displacement compressor is controlled to a maximum operation side to increase the flow rate of refrigerant drawn into the suction chamber. This control operation is continued until the differential pressure across the electromagnetic proportional flow rate control valve 12 becomes equal to the differential pressure corresponding to the openness set by the solenoid section 22. As a result, since the suction flow rate Qs of refrigerant is held constant, the discharge flow rate Qd of refrigerant is also held constant.

As described above, the differential pressure regulating valve 14*b* senses the differential pressure across the electromagnetic proportional flow rate control valve 12 arranged in the suction-side refrigerant passage 11, and controls the flow rate of refrigerant introduced from the discharge chamber 10 into the crank chamber 1, based on the sensed differential pressure, whereby the suction flow rate Qs of refrigerant drawn into the variable displacement compressor is controlled to a fixed flow rate corresponding to the differential pressure generated by the electromagnetic proportional flow rate control valve 12. Thus, a constant flow rate compressor is constructed which controls the discharge flow rate Qd to be constant irrespective of changes in the engine rotational speed.

Figure 8:
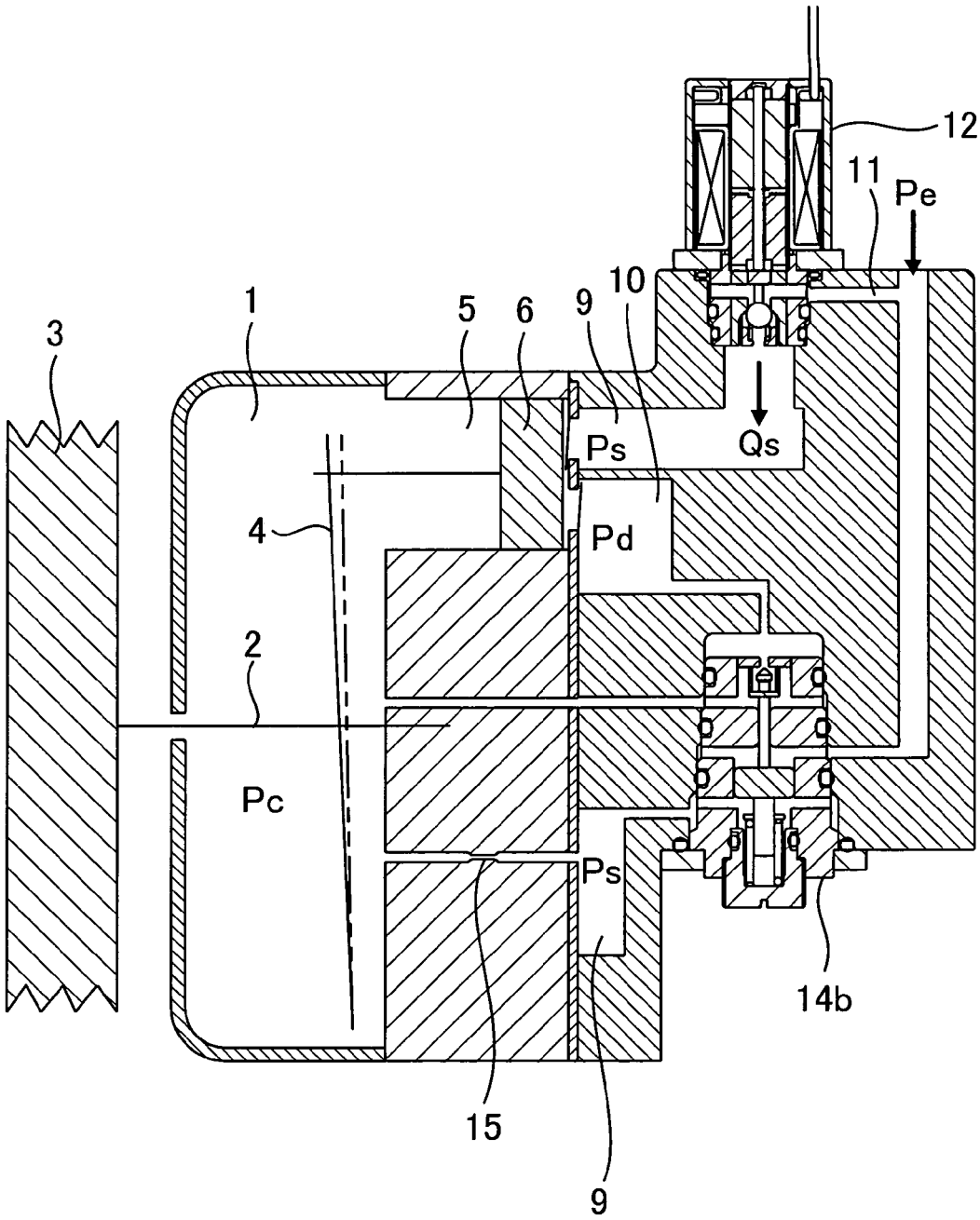
FIG. 8 is a cross-sectional view showing the construction of a variable displacement compressor according to a fourth embodiment.

FIG. 8 is a cross-sectional view showing the construction of a variable displacement compressor according to a fourth embodiment. It should be noted that in FIG. 8, component elements similar to or equivalent to those of the variable displacement compressor shown in FIG. 6 are designated by identical reference numerals, and detailed description thereof is omitted.

When compared with the variable displacement compressor according to the third embodiment, the variable displacement compressor according to the fourth embodiment is configured such that the port for introducing the discharge pressure Pd into the differential pressure regulating valve 14*b* and the port leading from the differential pressure regulating valve 14*b* to the crank chamber 1 are arranged in a reversed fashion. More specifically, a discharge chamber 10 is communicated with a port 42 formed in an end of a differential pressure regulating valve 14*b*, while a crank chamber 1 is communicated with a port 41 formed in a side of the differential pressure regulating valve 14*b*. As to the remainder, this variable displacement compressor has the same construction as that of the variable displacement compressor according to the third embodiment.

Further, operation carried out by the variable displacement compressor constructed as above is similar to that of the variable displacement compressor according to the third embodiment. More specifically, the differential pressure regulating valve 14*b* senses the differential pressure across a electromagnetic proportional flow rate control valve 12 arranged in a suction-side refrigerant passage 11, and controls the flow rate of refrigerant introduced from the discharge chamber 10 into the crank chamber 1, based on the sensed differential pressure, whereby the suction flow rate Qs of refrigerant drawn into the variable displacement compressor is controlled to a fixed flow rate corresponding to a differential pressure generated by the electromagnetic proportional flow rate control valve 12. Thus, a constant flow rate compressor is constructed which holds the discharge flow rate Qd to be constant even if the engine rotational speed and external loads are changed.

Although the above embodiments are configured such that the differential pressure regulating valve is arranged in the refrigerant passage communicating between the discharge chamber and the crank chamber 1, and the fixed orifice is provided in the refrigerant passage communicating between the crank chamber and the suction chamber, this is not limitative, but it is possible to arrange the differential pressure regulating valve and the fixed orifice at desired locations in the refrigerant passage communicating between the discharge chamber and the suction chamber through the crank chamber. Further, it is also possible to insert the differential pressure regulating valve and the fixed orifice in a manner reversed in location.

Further, although in the above descriptions, it is assumed by way of example that each of the variable displacement compressors of the above embodiments is connected to the output shaft of the engine via a clutch, a belt, and a pulley, this not limitative, but they can be applied to an air conditioning system for a so-called clutchless automotive vehicle which is configured such that an output shaft of an engine is directly coupled to a rotating shaft without interposing a clutch therebetween, since the electromagnetic proportional flow rate control valve forming the variable orifice can be switched to minimum operation in which the flow rate of refrigerant is reduced to approximately zero by setting a current value which can be externally set for the solenoid, to zero.

As described hereinabove, the present invention is configured such that the electromagnetic proportional flow rate control valve for generating a desired differential pressure is arranged at a location in the suction-side or discharge-side refrigerant passage; the fixed orifice and the differential pressure regulating valve are arranged at desired locations in the refrigerant passage extending from the discharge chamber to the crank chamber and further from the crank chamber to the suction chamber; the differential pressure regulating valve senses the differential pressure generated across the electromagnetic proportional flow rate control valve and adjusts an openness thereof such that a constant differential pressure is generated at an openness determined by the electromagnetic proportional flow rate control valve, in short, such that the discharge flow rate becomes constant; and the setting of the discharge flow rate dependent on changes in external conditions is controlled based on a value of electric current supplied to the electromagnetic proportional flow rate control valve. Since the present invention is configured such that a small differential pressure is generated in the refrigerant passage by the electromagnetic proportional flow rate control valve, it is possible to reduce the solenoid force for changing the openness, which is a set value of the discharge flow rate, in response to changes in external conditions, whereby the electromagnetic proportional flow rate control valve can be made compact in size.

Since the variable displacement compressor is constructed as a constant flow rate compressor, it is possible to always supply refrigerant at a fixed flow rate without being adversely affected by changes in the engine rotational speed, external load conditions, etc., which makes it possible to stabilize operation of the whole system.

Further, if a value of electric current to be supplied to the electromagnetic proportional flow rate control valve, which can be externally set, is set to zero, the variable displacement compressor can be set to the minimum capacity, and hence a clutchless compressor can be constructed. This makes it possible to construct a more inexpensive automotive air conditioning system.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A variable displacement compressor including a wobble body that is arranged in a crank chamber formed gastight, such that an inclination angle of the wobble body can be changed with respect to a rotating shaft, and is driven by rotation of the rotating shaft, for wobbling motion, and pistons connected to the wobble body, for performing reciprocating motion in a direction along axis in accordance with the wobbling motion of the wobble body, to thereby suck refrigerant from a suction chamber into a cylinder, compress the refrigerant, and deliver the compressed refrigerant from the cylinder to a discharge chamber, the variable displacement compressor comprising:

a variable orifice arranged in a suction-side refrigerant passage leading to the suction chamber or a discharge-side refrigerant passage leading to the discharge chamber, such that an openness thereof can be set according to changes in external conditions;

a differential pressure regulating valve arranged at a desired location in at least one of a first refrigerant passage leading from the discharge chamber to the crank chamber, and a second refrigerant passage leading from the crank chamber to the suction chamber, for sensing a differential pressure generated across the variable orifice and adjusting an openness thereof such that the differential pressure becomes equal to a predetermined value; and a fixed orifice arranged at a desired location in the first refrigerant passage and the second refrigerant passage, wherein a flow rate of refrigerant flowing into the suction chamber or a flow rate of the refrigerant discharged from the discharge chamber is caused to become substantially constant.

2. The variable displacement compressor according to claim 1, wherein the variable orifice is arranged in the suction-side refrigerant passage, the differential pressure regulating valve being arranged in the first refrigerant passage, and the fixed orifice being arranged in the second refrigerant passage.

3. The variable displacement compressor according to claim 1, wherein the variable orifice is arranged in the discharge-side refrigerant passage, the differential 20 pressure regulating valve being arranged in the first refrigerant passage, and the fixed orifice being arranged in the second refrigerant passage.

4. The variable displacement compressor according to claim 1, wherein the variable orifice is an electromagnetic proportional flow rate control valve including a solenoid enabling the predetermined value to be externally set by a current value.

5. The variable displacement compressor according to claim 4, wherein the electromagnetic proportional flow rate control valve is switched to a minimum operation in which the flow rate of refrigerant is reduced substantially to zero by setting the current value which can be externally set for the solenoid, to zero.

6. The variable displacement compressor according to claim 5, wherein the variable displacement compressor is applied to a clutchless air conditioning system for an automotive vehicle.

* * * * *